United States Patent [19]

Truscott

[11] Patent Number: 5,001,864

[45] Date of Patent: Mar. 26, 1991

[54] SHUTTER ASSEMBLIES

[76] Inventor: Robert D. Truscott, 52 Pompallier Terrace, Ponsonby, Auckland, New Zealand

[21] Appl. No.: 426,579

[22] Filed: Oct. 24, 1989

[30] Foreign Application Priority Data

Oct. 28, 1988 [NZ] New Zealand ..... 226760

[51] Int. Cl.[5] ..... E06B 7/08

[52] U.S. Cl. ..... 49/403; 49/74; 160/236

[58] Field of Search ..... 49/403, 74, 92; 160/236, 172

[56] References Cited

U.S. PATENT DOCUMENTS

| | | | |
|---|---|---|---|
| 501,810 | 7/1893 | Bohren | 49/403 |
| 1,015,144 | 1/1912 | Daly | 49/403 |
| 2,174,249 | 5/1936 | Pratt | 160/236 |
| 2,217,217 | 10/1940 | Engstrom | 160/236 X |
| 2,822,587 | 2/1958 | Hallock | 49/92 |
| 2,926,729 | 3/1960 | Zanini | 160/236 |
| 2,995,787 | 8/1961 | Sarria | 49/92 X |
| 3,110,936 | 11/1963 | Berard | 160/236 |
| 3,375,608 | 4/1968 | Thompson | 49/74 X |
| 4,103,601 | 8/1978 | Dayus | 49/74 X |
| 4,509,290 | 4/1985 | Stanfield, Jr. | 49/92 |

*Primary Examiner*—Gary L. Smith
*Assistant Examiner*—Jerry Redman
*Attorney, Agent, or Firm*—Harness, Dickey & Pierce

[57] ABSTRACT

In a shutter assembly (10) for buildings and the like, an array of parallel louvers (11) are preferably made of wood or wood product or of plastics material. Each louver is located by a pair of mounting arms (15) pivoted to parallel upright mullions (12). Each mounting arm has a tongue (18) protruding therefrom and engaged in a slot formed in the end of the louver. Thus, the tongue is invisible.

15 Claims, 4 Drawing Sheets

11
13
15
16
18
20
24

SHUTTER ASSEMBLIES

FIELD OF THE INVENTION

This invention relates to a shutter assembly for buildings and the like, and to components for such a shutter assembly.

BACKGROUND OF THE INVENTION

Known shutter assemblies of the general type to which this invention belongs normally include clips or brackets, which are pivoted to mullions or side frames of an aperture, and which clip or brackets hold and locate the ends of louvres. Very commonly the louvres are of glass, but in any case the clips or brackets have portions which extend over parts of both the major louvre faces which are exposed to the interior and exterior of the room, when the shutter assembly is closed.

Such a construction has major disadvantages. Firstly, the clip portions mentioned are visible and, being often of metal are visually obtrusive. Secondly, they interfere with the desired close fit of adjacent louvres when the shutter assembly is closed. Thirdly, the clip portions exposed to the exterior of the room can easily be bent open, enabling the louvre to be removed and the room thereafter entered.

U.S. Pat. No. 2716786 issued 10 Jan. 1955 to J. A. Moore is typical of prior art shutter assemblies of this type.

SUMMARY OF THE INVENTION

According to one aspect of the present invention, there is provided a shutter assembly, for buildings and the like, including a plurality of louvres, and a pair of mounting arms for each louvre, each mounting arm having a face to bear against an end face of the louvre and having a louvre locating protrusion to engage in or against the louvre, the protrusion being located on the mounting arm so as not to be visible from one side of the shutter assembly when the louvres are in a closed position.

Preferably, each end face of the louvre is formed with a longitudinal slot in which the louvre locating protrusion is to be engaged.

Conveniently, the cross-section of at least part of the mounting arm is substantially L-shaped, one limb of the L defining said face to bear against the end face of the louvre, and the other limb of the L constituting the locating protrusion to be engaged in the longitudinal slot.

Alternatively, there may be provided a shutter assembly in which the cross-section of at least part of the mounting arm is substantially T-shaped, the head of the T defining, either side of the stem of the T, a pair of co-planar faces to bear against said end face of the louvre, and the stem of the T constituting the locating protrusion to be engaged in the longitudinal slot.

According to another aspect of the present invention there is provided a louvre mounting arm for use in a shutter assembly, for buildings and the like, in which the assembly includes a plurality of louvres, and a pair of mounting arms for each louvre, the mounting arm having a face to bear against an end face of the louvre and having a louvre locating protrusion to engage in or against the louvre, the protrusion being located on the mounting arm so as not to be visible from one side of the shutter assembly when the louvres are in a closed position.

Preferably the louvre locating protrusion is shaped so as to be engagable in a longitudinal slot formed in the end face of the louvre.

According to a further aspect of the present invention there is a provided a louvre for use in a shutter assembly, for buildings and the like, in which the assembly includes a plurality of louvres, and a pair of mounting arms for each louvre, each mounting arm having a face to bear against an end face of the louvre and having a louvre locating protrusion to engage in the louvre, the protrusion being located on the mounting arm so as not to be visible from either side of the shutter assembly when the louvres are in a closed position, in which each end face of the louvre is formed with a longitudinal slot in which the louvre locating protrusion is to be engaged.

Preferably, the assembly includes a resilient member engagable between the mounting arm and the interior of the slot in the louvre and adapted to allow relative movement between the arm and the louvre in said one direction but to inhibit said relative movement in a direction opposite to said one direction, the resilient member being cantilevered outwards from the protrusion of the mounting arm and being pressed towards the mounting arm by the interior of the slot as the protrusion is slid along the slot in said one direction, and in which the slot in the louvre includes a depression into which the free end of the cantilever becomes engaged.

BRIEF DESCRIPTION OF THE DRAWINGS

One embodiment of the invention is described by way of example only, with reference to the accompanying drawings, in which.

Figure 1:
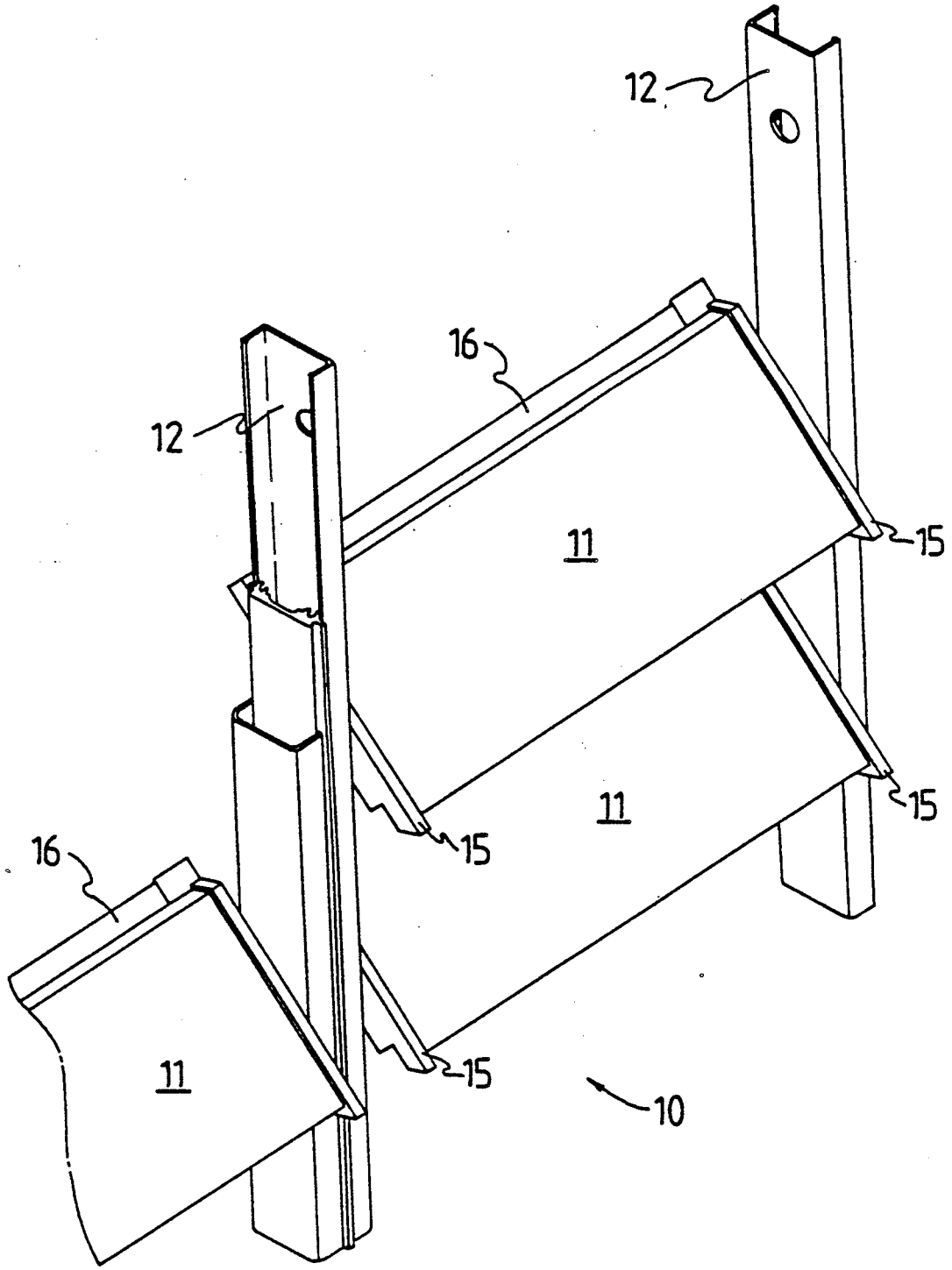
FIG. 1 is a perspective view of a shutter assembly according to the invention.

In the drawings, a shutter assembly 10 includes a plurality of parallel rigid louvres 11 located between a pair of upright parallel mullions 12. The mullions 12 can be fastened in an aperture of an exterior or interior wall of a building, so that when the louvres 11 are pivoted to an upright position the aperture is closed, so as to inhibit the passage of wind, rain, dust, insects, noise or intruders. The louvres 11 can be set at various inclinations to admit more or less heat, light and ventilation, as required.

Each louvre 11 is preferably made of wood, which expression includes plywood, blockboard, chipboard, fibreboard or other wood-derived products, provided that it is of adequate strength, stiffness and durability. Each louvre 11 has opposing edge section 16 stepped in profile in a substantially complimentary manner so that, when closed, the bottom outside edge of one louvre 11 overlaps the upper inside edge of the louvre 11 below it. The louvres 11, may conveniently be cut from a plank of wood of suitable profile. Each end face of each louvre 11 has a recess such as a slot 17 formed therein, which may be formed on site by relatively simple tools, for example, by a single cut by a hand or power saw, router or the like.

Figures 2, 3:
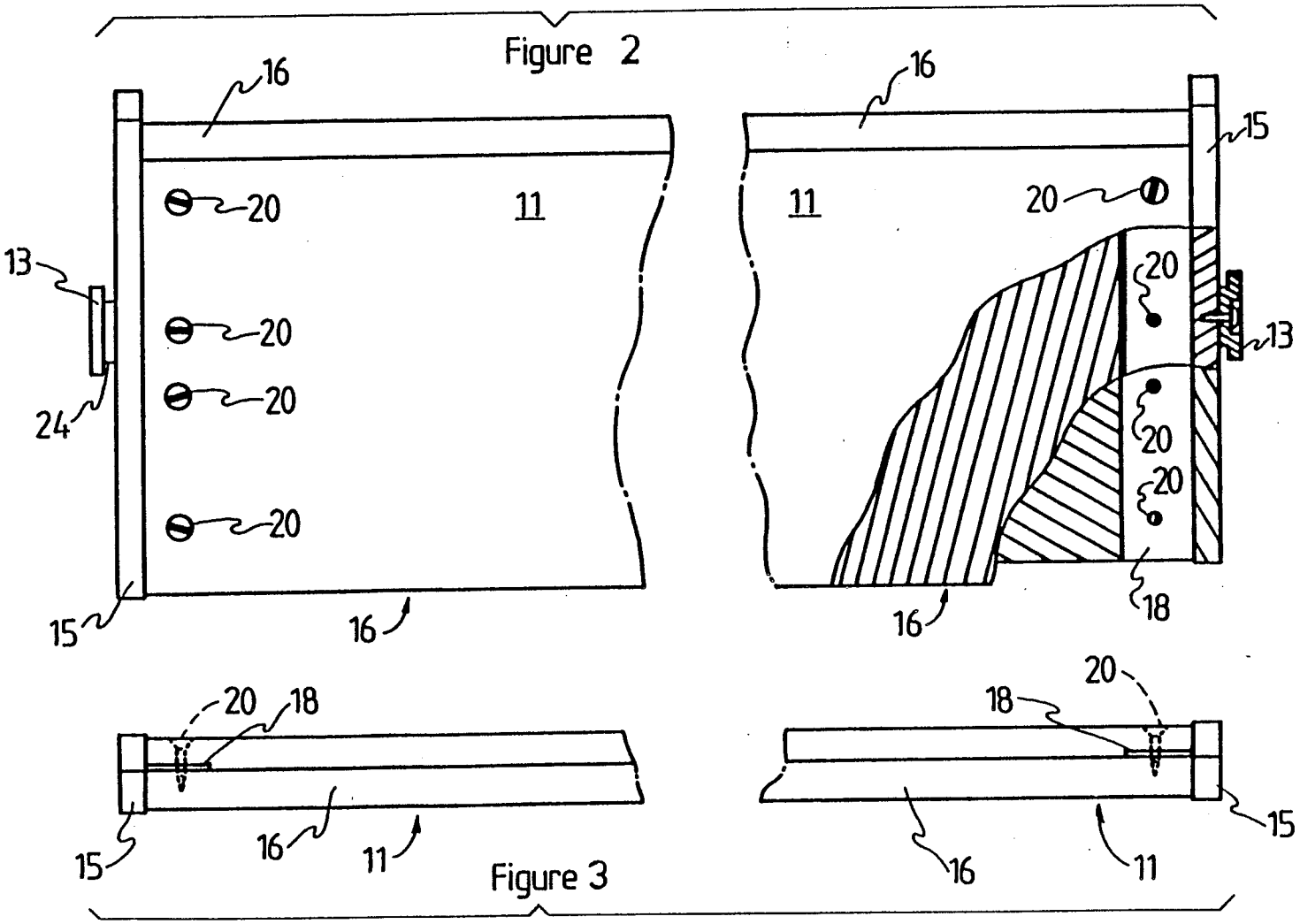
FIG. 2 is a plan view of a louvre and mounting arm assembly for use in the shutter assembly of FIG. 1.
FIG. 3 is a front elevation of the assembly shown in FIG. 2.
Figure 4:
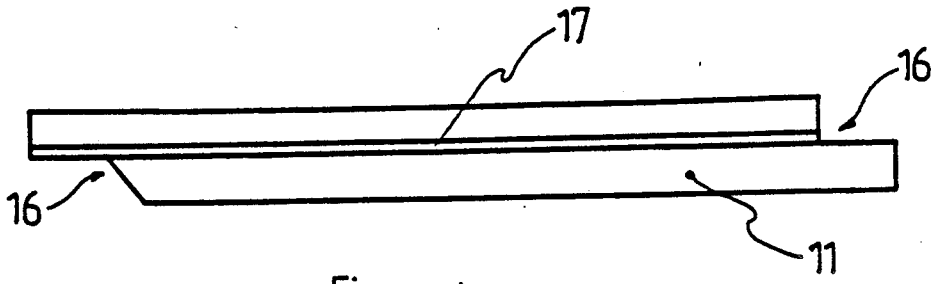
FIG. 4 is an end view of the louvre shown in FIGS. 2 and 3.
Figure 5:
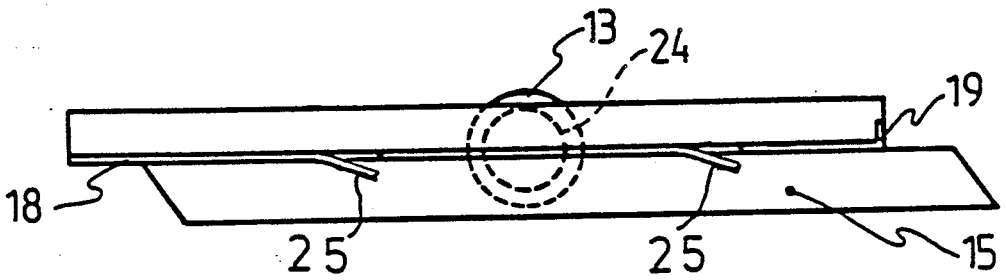
FIG. 5 is an end view of one mounting arm shown in FIG. 2.
Figure 6:
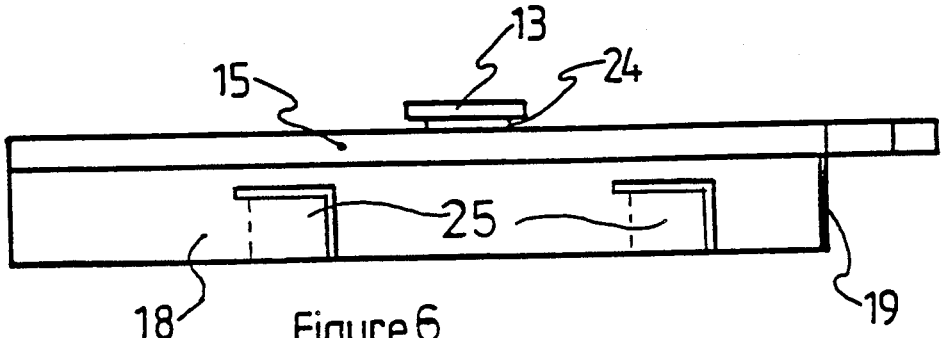
FIG. 6 is a plan view of the mounting arm shown in FIG. 5.
Figure 10:
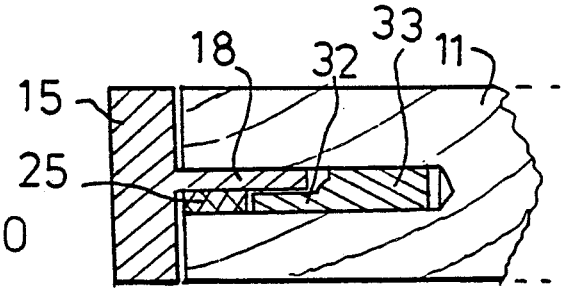
FIG. 10 is a scrap section to enlarged scale of part of a louvre showing the strip shown in FIG. 9, in use.

Each louvre 11 is located and carried by a mounting arm 15 at each end thereof As seen in FIGS. 3 and 10, each mounting arm 15 is conveniently of T cross-section, of which the stem forms a tongue 18 which fits into the slot 17 of the louvre 11. The head of the T abuts the adjacent end face of the louvre 11, on either side of the tongue 18. For security, screws 20 may be driven through the louvre 11 and the tongue 18.

Each louvre 11 is pivoted on the mullions 12 by means of spigots 24 which are engaged in opposed apertures in the mullions 12. Each spigot 24 carries a collar 13 which may have an integral operating arm and the operating arms are all joined together by an unshown linkage, in known manner, so that all the louvres 11 may be pivoted simultaneously about their spigots 24 for the purpose of opening and shutting the shutter assembly 10.

Installation of the shutter assembly 10 is conveniently effected by assembling the mounting arms 15 on the spigots 24 to the mullions 12, which are then affixed in parallel disposition within the wall aperture. The louvres 11 are then cut to length to fit between the opposed mounting arms 15, the slots 17 are formed and each louvre 11 is then slid between the mounting arms 15 with the tongues 18 within the slots 17. The relative sliding is stopped by an abutment 19, which is formed out of the plane of the tongue 18, being reached by an edge face of the louvre 11. The screws 20 may then be inserted, preferably from the interior of the building for maximum security.

Figure 8:
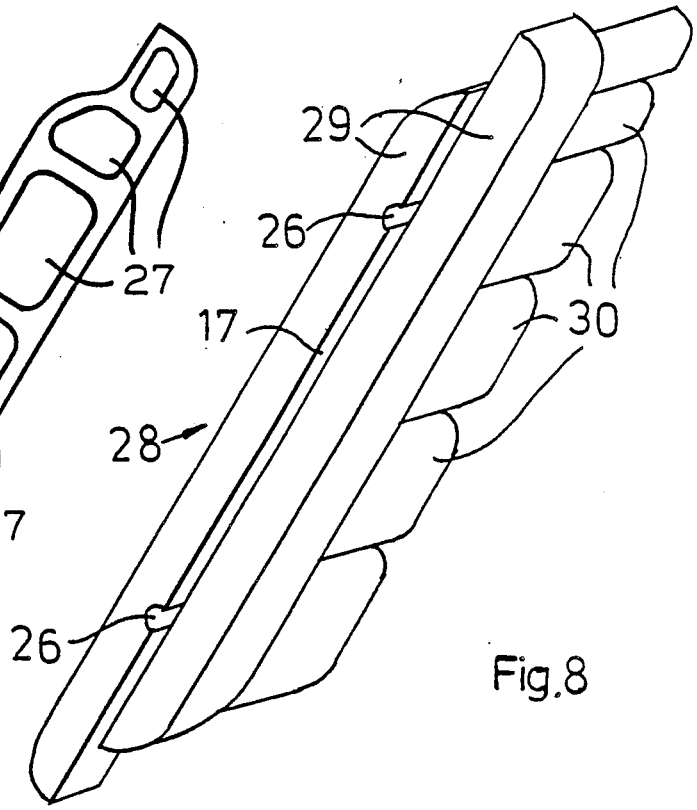
FIG. 8 is a perspective view of an end member to be used with the louvre shown in FIG. 7.

Alternatively, each mounting arm 15 may be provided with a resilient member, such as an outwardly-sprung cantilevered member 25, which is bent towards the tongue 18 by one side of the slot 17, as the tongue 18 is slid along the slot 17. Relative movement in the opposite direction is prevented, either by the members 25 digging into the wood, or preferably by them engaging into depressions 26 formed in the wall of the slot 17, as shown in FIG. 8.

Figure 7:
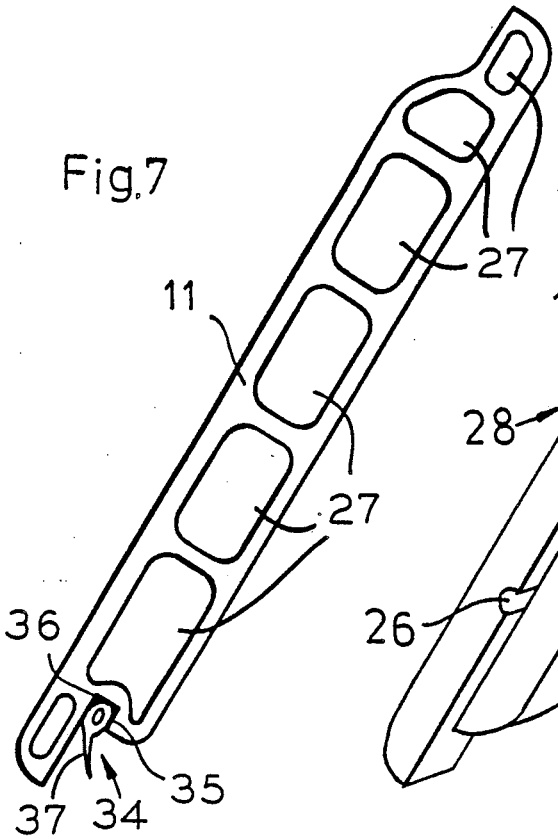
FIG. 7 is a cross-section through an alternative louvre to that shown in FIG. 1.

Instead of wood, as hereinbefore defined, the louvres 11 may be formed of any other suitable material, such as a plastics material, for example, plastics having a cellular construction. In FIG. 7, the louvre is of extruded plastics material, in tubular form, having a plurality of parallel elongate apertures 27 therethrough. Each end of the louvre 11 is completed, as shown in FIG. 8, by a moulded plastics member 28 in which is formed the slot 17 and having an end face 29 for abutment against the adjacent faces of the mounting arm 15. On the opposite side of the member 28 to the face 29 there protrude a row of integral plugs 30, each dimensioned to fit closely into one of the apertures 27 in the extruded louvre 11.

Figure 9:
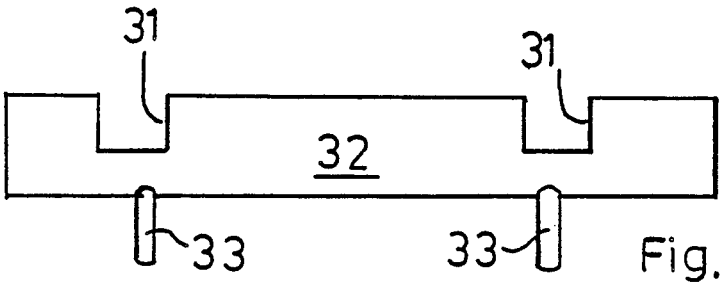
FIG. 9 is a plan view of a strip member to be used in the louvre shown in FIG. 2.

As shown in FIG. 9, in any louvre material, as an alternative to the depression 26, the flexible members 25 can be arranged to catch in gaps 31 formed in one edge of a flat strip of material 32, which has a pair of pegs 33 protruding from the opposite edge thereof. As shown in FIG. 10, the strip 32 is located within the slot 17, with the pegs 33 inserted into holes drilled into the bottom of the slot 17.

Any of the louvres 11 just described, can have an additional seal to the next adjacent louvre 11. For example, as shown in FIG. 7, where an elongate elastomeric seal 34 has a head 35 engaged in a groove 36, and a continuous sealing lip 37 to abut a face on the next adjacent louvre 11.

Instead of the mounting arms 15 being of T-section, they could be of L-section, one limb of the L constituting the tongue 18, to enter the slot 17 or be fastened against the interior face of one louvre 11. The other limb of the L would then bear against the end face of the louvre 11.

The constructions described above have the advantage that the tongue 18 is not visible from one side of the louvres 11, and if it is located in the slot 17, it is invisible from both sides of the louvre 11. This construction provides improved appearance and also security.

What I claim is:

1. A shutter assembly, for buildings, including a plurality of louvres, and a pair of mounting arms for each louvre, each mounting arm having a face to bear against an end face of the louvre and having a louvre locating protrusion to engage a recess in the end face of the louvre, wherein the improvement comprises the protrusion being located on the face of the mounting arm so as not to be visible from one side of the shutter assembly when the louvres are in a closed position, the protrusion having a resilient member which engages the recess of the louvre and is adapted to allow relative movement between the arm and the louvre in one direction but to inhibit relative movement in a direction opposite to said one direction.

2. A shutter assembly, as in claim 1, in which each end face of the louvre is formed with a longitudinal slot in which the louvre locating protrusion is to be engaged.

3. A shutter assembly, as in claim 2, in which a cross-section of at least part of the mounting arm is substantially T-shaped with a head portion and a stem portion, the head portion of the T defining a pair of co-planar faces disposed on either side of the stem portion of the T, the co-planar faces bearing against said end face of the louvre, and the stem portion of the T constituting the locating protrusion to be engaged in the longitudinal slot.

4. A shutter assembly, as in claim 2, in which the mounting arm has one end which is provided with an abutment against which the louvre is to be abutted, so as to limit relative movement between the arm and the louvre in said one direction.

5. A shutter assembly, as in claim 2, in which the resilient member has a free end which is cantilevered outwards from the protrusion of the mounting arm and is pressed towards the mounting arm by the interior of the louvre recess as the protrusion is slid along the louvre recess in said one direction, and in which the free end is caused to stick into the louvre material by attempts to slide the protrusion in the said direction opposite to said one direction.

6. A shutter assembly, as in claim 5 in which the recess in the louvre includes a depression into which the free end of the cantilever becomes engaged.

7. A shutter assembly, as in claim 6, in which a strip of material is affixed to the louvre within the louvre recess, said depression being formed in said strip.

8. A shutter assembly, as in claim 7 in which the strip of material is formed with a peg extending normal to the length of the strip and substantially in the plane thereof, the peg being inserted in a hole formed in the louvre in the base of said depression.

9. A louvre mounting arm for use in a shutter assembly, for buildings, in which the assembly includes a plurality of louvres, and a pair of mounting arms for each louvre, the mounting arm having a face to bear against an end face of the louvre and having a louvre locating protrusion to engage a recess in the end face of the louvre, wherein the improvement comprises the protrusion being located on the face of the mounting arm so as not to be visible from one side of the shutter assembly when the louvres are in a closed position, the protrusion having a resilient member which engages the recess of the louvre and is adapted to allow relative movement between the arm and the louvre in one direction but to inhibit relative movement in a direction opposite to said one direction.

10. A mounting arm, as in claim 9, in which the louvre locating protrusion is shaped so as to be engagable in a longitudinal slot formed in the end face of the louvre.

11. A mounting arm, as in claim 9 in which the mounting arm is made of plastics material.

12. A louvre assembly for use in a shutter assembly, for buildings, in which the louvre assembly includes a plurality of louvres, and a pair of mounting arms for each louvre, each mounting arm having a face to bear against an end face of the louvre and having a louvre locating protrusion to engage the end face of the louvre, the protrusion being located on the mounting arm so as not to be visible from either side of the shutter assembly when the louvres are in a closed position, wherein the improvement comprises each end face of the louvre being formed with a longitudinal slot in which the louvre locating protrusion is to be engaged, the protrusion having a resilient member which engages the longitudinal slot of the louvre and is adapted to allow relative movement between the arm and the louvre in one direction but to inhibit relative movement in a direction opposite to said one direction.

13. A louvre assembly, as in claim 12, in which the resilient member has a free end which is cantilevered outwards from the protrusion of the mounting arm and is pressed towards the protrusion by the interior of the slot as the protrusion is slid along the slot in said one direction, wherein the improvement further comprises the slot in the louvre including a depression into which the free end of the resilient member becomes engaged.

14. A louvre assembly as in claim 12 in which the louvre is of extruded plastics material of cellular construction comprising elongate parallel tubular formations.

15. A louvre assembly, as in claim 14, in which said end face of the louvre is formed on one side of a plastics body, the opposite side of which is formed with a plurality of integral plugs to enter and fit in said tubular formations.

* * * * *